US006648653B2

(12) United States Patent
Huang et al.

(10) Patent No.: US 6,648,653 B2
(45) Date of Patent: Nov. 18, 2003

(54) SUPER MINI COAXIAL MICROWAVE CONNECTOR

(75) Inventors: Tung-Liang Huang, Hsin-Tien (TW); Sung-Wen Chen, Hsin-Tien (TW)

(73) Assignee: Insert Enterprise Co., Ltd., Taipei Hsien (TW)

( * ) Notice: Subject to any disclaimer, the term of this patent is extended or adjusted under 35 U.S.C. 154(b) by 20 days.

(21) Appl. No.: 10/035,313

(22) Filed: Jan. 4, 2002

(65) Prior Publication Data

US 2003/0129858 A1 Jul. 10, 2003

(51) Int. Cl.[7] ..... H01R 9/09
(52) U.S. Cl. ..... 439/63; 439/582
(58) Field of Search ..... 439/63, 582, 578–585, 439/854, 855, 859, 394, 675, 881, 902, 769; 639/83, 81, 850, 851, 853, 780, 782, 783, 790, 800, 870

(56) References Cited

U.S. PATENT DOCUMENTS 3,771,111 A * 11/1973 Pritulsky ..... 439/223 R
5,772,470 A * 6/1998 Togashi ..... 439/582
6,474,995 B1 * 11/2002 Wu ..... 439/63
6,503,100 B2 * 1/2003 Yamane ..... 439/582
6,508,668 B1 * 1/2003 Yamane ..... 439/582

* cited by examiner

*Primary Examiner*—P. Austin Bradley
*Assistant Examiner*—Phuongchi Nguyen
(74) *Attorney, Agent, or Firm*—Troxell Law Office PLLC

(57) ABSTRACT

A super mini coaxial microwave connector having a receptacle part and a plug part. The receptacle is a metal connector body associated with an insulator, at the lower end thereof. The insulator extends into the connector body and provides an upper projection end. The projection end at the inner part, engages with a male terminal and the lower end of the male terminal extends outward from the insulator and the connector body. The upper end of the male terminal is a round end. The plug part has a metal casing and the metal casing joins with another insulator. The insulator has a central hollow part to fit with a female terminal. The female terminal at the upper plate thereof has an extending downward stop neck and two downward stop plates extending from both ends of the rear side of the stopper respectively.

20 Claims, 20 Drawing Sheets

SUPER MINI COAXIAL MICROWAVE CONNECTOR

BACKGROUND OF THE INVENTION

1. Field of the Invention

The present invention relates to a connector, and particularly to a super mini coaxial microwave connector, which provides a receptacle part soldered to a circuit board.

2. Description of Related Art

A soldered super mini sized connector available in the market has a receptacle part 10 as shown in FIG. 1 and the bottom of the receptacle part 10 is soldered to a circuit board in a notebook computer, a personal digital assistant, or a mobile phone. The plug part 20 of the connector fits with the receptacle part 10 as shown in FIG. 2 and another end of the plug part 20 can be connected to, for example, an antenna of the mobile phone via a signal line for signal transmission. The receptacle part 10 has a metal connector body 11 and the lower end of the connector body 11 is in conjunction with an insulator 12. The insulator 12 extends into the connector body 11 and provides a central protrusion end 121 such that a male terminal 13 is arranged in the protrusion end 121. The male terminal 13 at the lower end 131 thereof provides a shape of flat plate and at the upper end 132 thereof provides a shape of tube with an arc end 133. The plug part 20 has a metal casing 21 associated with an insulator 22. The insulator 22 has a hollow part 221 associated with a female terminal 23 as shown in FIG. 3. The female terminal 23 is composed of two opposite contacts 231 spacing apart each other with a little distance. As soon as the plug part 20 fits with the receptacle part 10, the two contacts 231 of the female terminal 23 on the insulator 22 are inserted into both lateral sides of the male terminal 13 to allow two signal ends being in a state, of communicating with each other. Further, the metal casing 21 surrounds the connector body 11 and engages with the connector body 11 to allow two grounding ends in a state of communicating with each other. Because the male terminal 13 contacting with the female terminal 23 is a line contact and it is not possible to constitute a firm contact actually. When the circuit board in the electronic product is moved or swung by the user during the electronic product being in use, it may result in a worse quality of signal transmission easily because of an unsteady contact between the two terminals or result in a disconnection of signal because of the two terminals being fallen apart.

Referring to FIGS. 4 and 5, when the receptacle part is made, male terminals 13 on a male terminal blanking band 130 are placed in central hollow space of connector bodies 11 on a connector body blanking band 110 as shown in FIG. 5. Then, the blanking bands 110, 130 are placed in a mold to form insulators 12 between the male terminals 13 and the connector bodies 11 respectively by way of plastic material being injected into the mold. Finally, the receptacle part 10 shown in FIGS. 6 and 7 can be obtained after the lower ends 131 and the connecting plates 111 being cut apart the blanking bands. The connecting plates 111 of the receptacle part 10 are used for holding the connector bodies 11. Two guide pieces 112 extend from the bottom of the respective connector body 11 and are used for being soldered to the circuit board as grounding. The respective connecting plate 111 extending beyond the respective insulator 12 may touch neighboring electronic parts to occur short circuit easily during setting up the microwave connector. Further, the sharp edges resulting from the cut connecting plates may hurt the fingers of the worker during assembling the connector. Referring to FIG. 5 again, the connector bodies 11 connect with the blanking band 110 via the connecting plates 111 only so that the connector bodies 11 may deviate from the original positions thereof during injection molding the insulators 12 and the male terminals are not possible to be located at the center of the respective connector body 11 so that it is easy to cause a lot of undesirable defectives. Moreover, the connector body may be subjected to a unidirectional force during the connecting plates being cut such that the connector body 11 becomes deformed easily to increase the defectives.

Referring to FIGS. 2 and 8, while the plug part 20 is in assembling, the female terminal 23 and the coaxial line (not shown) in company with the insulator 22 are placed into a central hole 211 of the casing 21 perpendicularly. Then, the inner lead wire in the coaxial line is soldered to or clamped at the upper plate 232 on the female terminal 23. Because the upper plate 232 does not provide any stop piece so that it is hard to control the length of the inner lead wire for being joined to the upper plate 232 and it is hard to solder the inner lead wire to the upper plate 232 steadily. If the inner lead wire is clamped at the upper plate 232, it is very possible for the inner lead wire being away the upper plate 232 easily to disable the signal transmission as soon as the circuit board is swung or moved.

SUMMARY OF THE INVENTION

An object of the present invention is to provide a super mini coaxial microwave connector, which is possible to be fabricated easily and can lower down the defective rate of product and the production cost respectively.

Another object of the present invention is to a super mini coaxial microwave connector, which offers a structure for the male terminal joining the female terminal steadily so as to enhance the quality of signal transmission.

BRIEF DESCRIPTION OF THE DRAWINGS

The present invention can be more fully understood by reference to the following description in company with drawing, in which.

DETAILED DESCRIPTION OF THE PREFERRED EMBODIMENT

Figure 2:
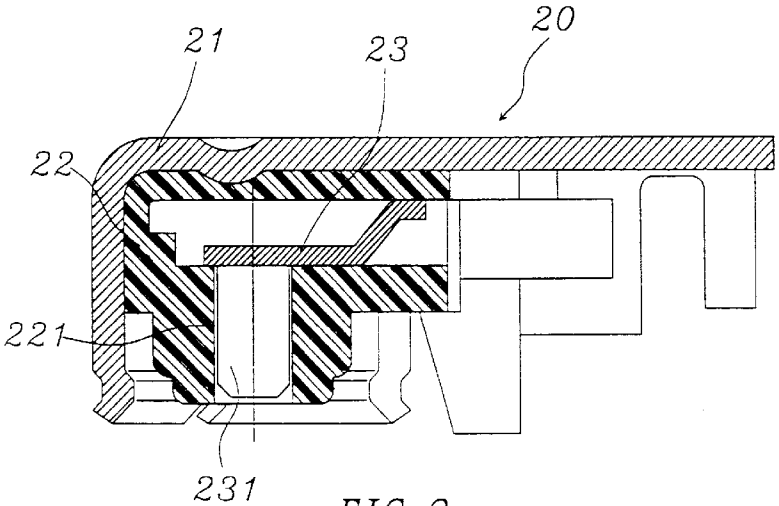
FIG. 2 PRIOR ART
FIG. 2 is a sectional view of a plug part in a conventional connector.
Figure 1:
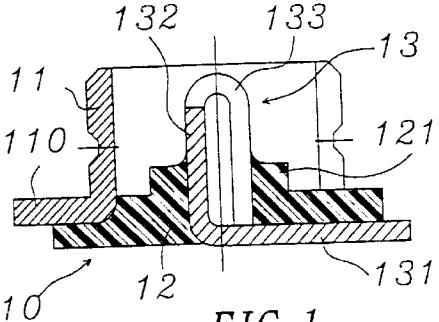
FIG. 1 PRIOR ART
FIG. 1 is a sectional view of a receptacle part in a conventional connector.
Figure 3:
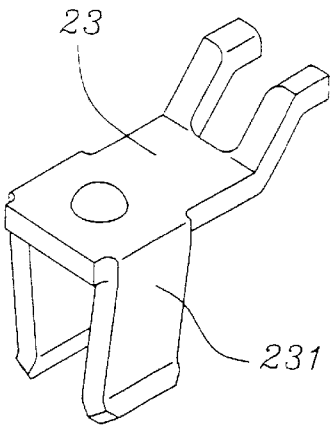
FIG. 3 PRIOR ART
FIG. 3 is a perspective view of a female terminal in a conventional connector.
Figure 4:
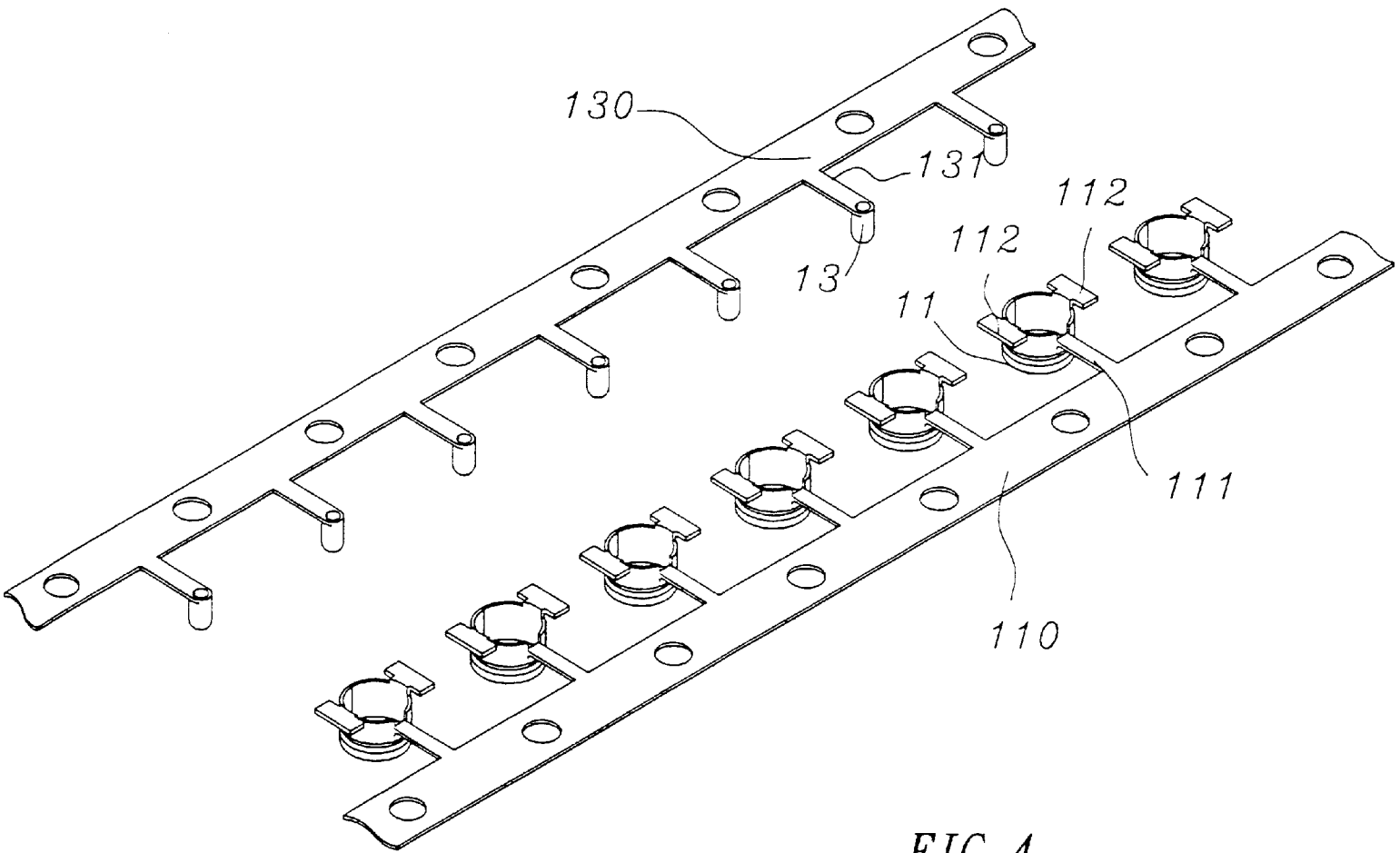
FIG. 4 PRIOR ART
FIG. 4 is a perspective view of a blanking band for conventional male terminals.
Figure 5:
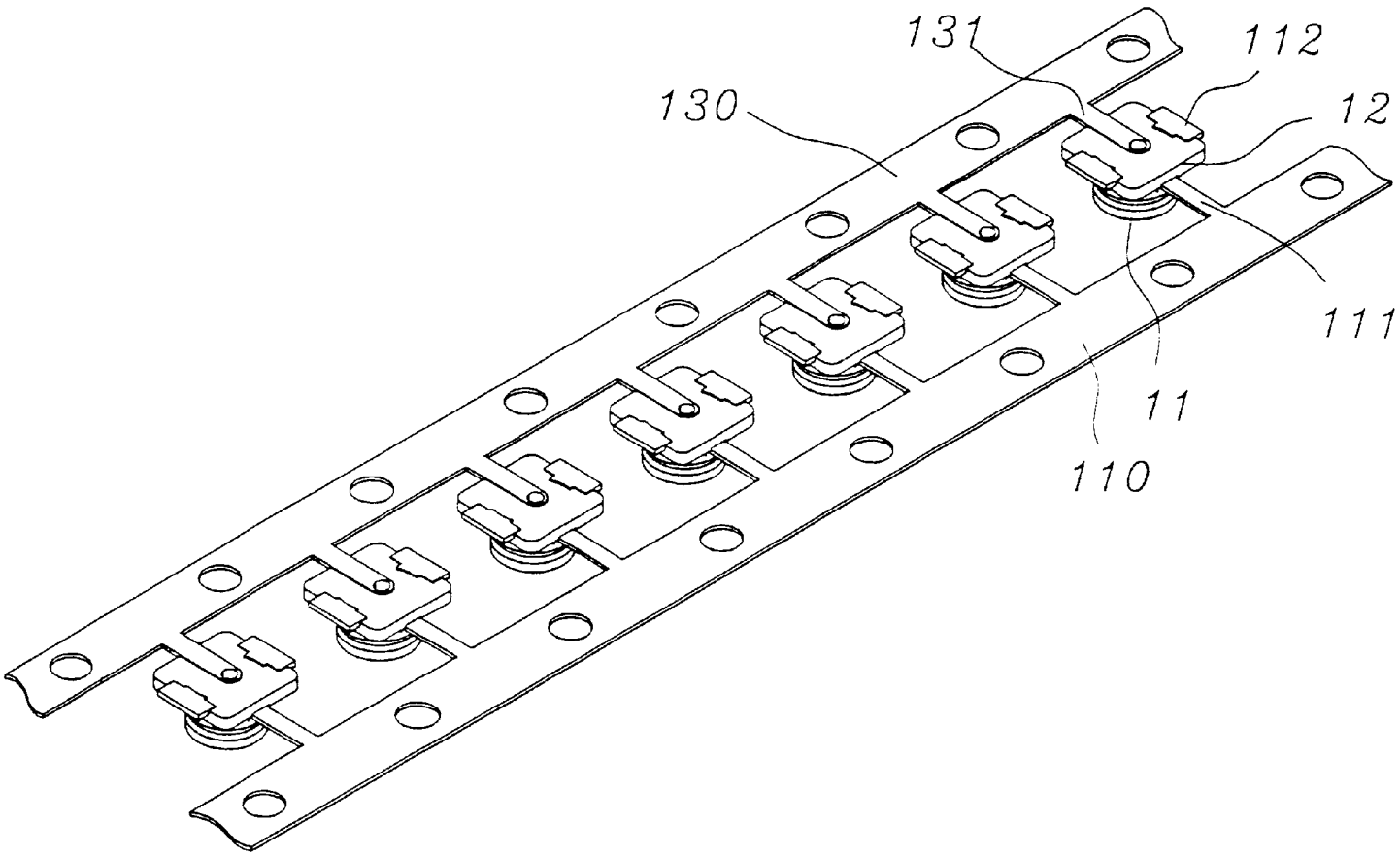
FIG. 5 PRIOR ART
FIG. 5 is a perspective view illustrating a blanking band for conventional male terminals and a blanking band for connector bodies joining insulators.
Figure 10:
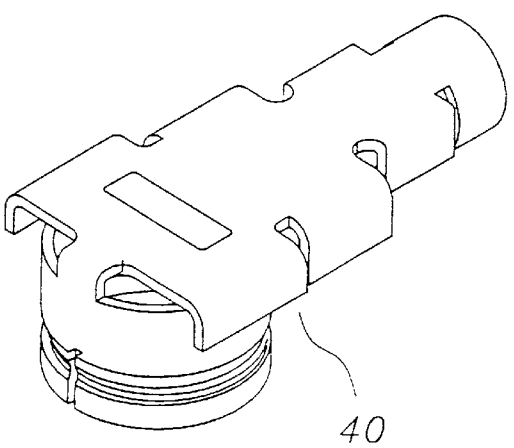
FIG. 10 is a perspective view illustrating a receptacle part and a plug part according to the present invention.
Figure 10:
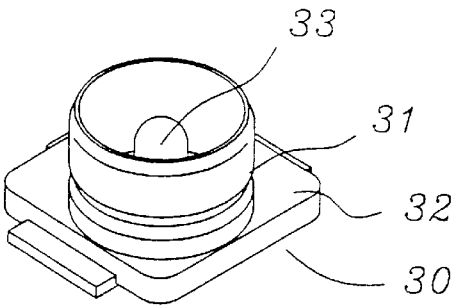
Figure 9:
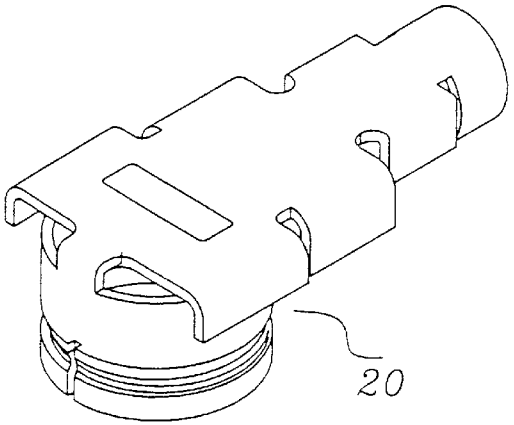
FIG. 9 PRIOR ART
FIG. 9 is a perspective view illustrating a receptacle part and the plug part in a conventional connector.
Figure 9:
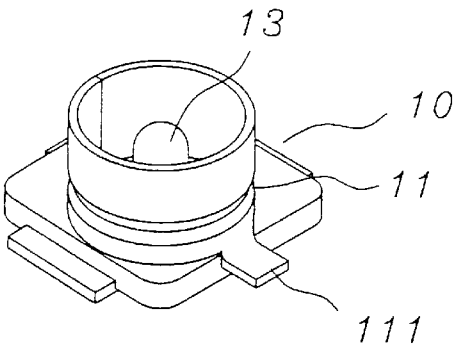
FIG. 9 PRIOR ART
Figure 11:
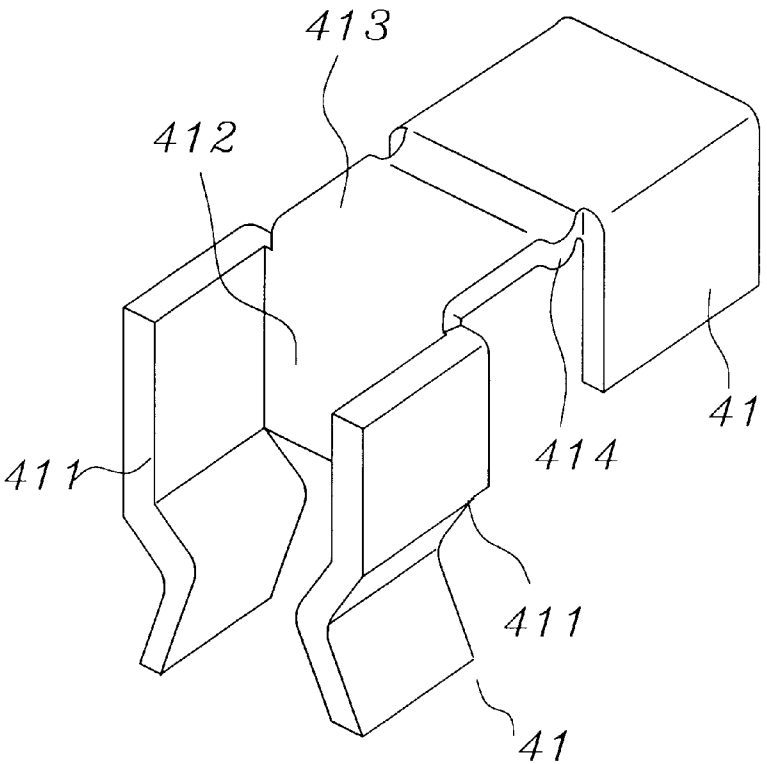
FIG. 11 is a perspective view of a female terminal in a first embodiment of the present invention.

Referring to FIG. 10, an appearance of the receptacle part 30 and the plug part 40 in a super mini coaxial microwave connector according to the present invention is illustrated respectively and it can be seen that the receptacle part 30 and the plug part 40 are almost identical with the receptacle part 10 and the plug part 20 in the conventional connector shown in FIG. 9. The difference of the connector disclosed in the present invention from the prior art is in that the connector of the present invention does not provide connecting piece extending from a connector body 31 of the receptacle part 30 but the connecting piece 111 shown in FIG. 9 does extend from the receptacle part 11. The female terminal 41 of the plug part 40 (shown in FIG. 11) in the connector of the present invention has an upper plate 413 and a back plate 412 being bent downward. The back plate 412 at two opposite sides thereof has a bent contact plate 411 respectively. The two contact plates 411 and the back plate 412 are used for contacting with the male terminal 33 of the receptacle part 30 and FIG. 2 shows a female terminal 23 in the conventional connector contacts with the male terminal 13 of the receptacle part by way of two contact plates 231 only so that the female terminal 41 can contact with the male terminal 33 much more steadily if it compares to the female terminal 23 contacting with the male terminal 13 in the conventional connector. Further, the upper plate 413 on the female terminal 41 has a concave stop neck 414 with two opposite downward bent stop plates 415 behind the stop neck 414. An inner lead wire at a partial length thereof extended into the coaxial line can be fixed and soldered between the stop neck 414 and the stop plates 415. The inner lead wire at another partial length thereof extended under the upper plate 413 can be fixed and soldered under the upper plate 413 steadily such that the speed for the coaxial line joining with the female terminal can be enhanced with a promoted joint steadily.

Figure 12:
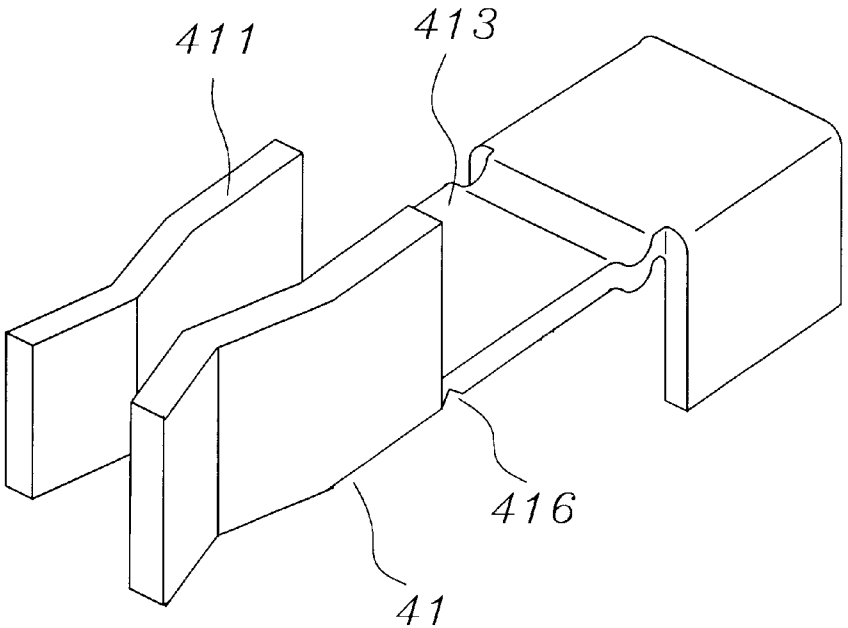
FIG. 12 is a perspective view illustrating the female terminal shown in FIG. 11 before being bent.

Referring to FIG. 12, the female terminal 41 has two contact plates 411 and the back plate thereof being in a state of being not bent downward before the receptacle part being assembled. A recess 416 is provided at a joint between the back plate and the upper plate 413 to facilitate the back plate being bent downward and to offer a specific position during bending the back plate.

Figure 8:
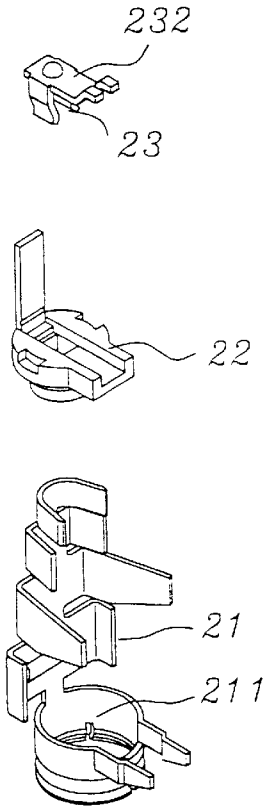
FIG. 8 PRIOR ART
FIG. 8 is a disassembled perspective view of a plug part in a conventional connector.
Figure 6:
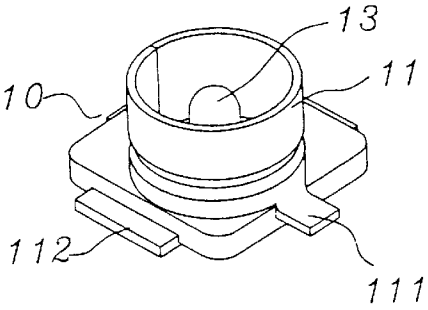
FIG. 6 PRIOR ART
FIG. 6 is a perspective view of a receptacle part in a conventional connector.
Figure 7:
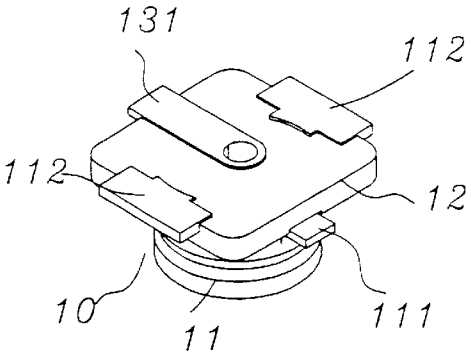
FIG. 7 PRIOR ART
FIG. 7 is a perspective view of the receptacle part shown in FIG. 6 illustrating the receptacle part being positioned bottom up.
Figure 13B:
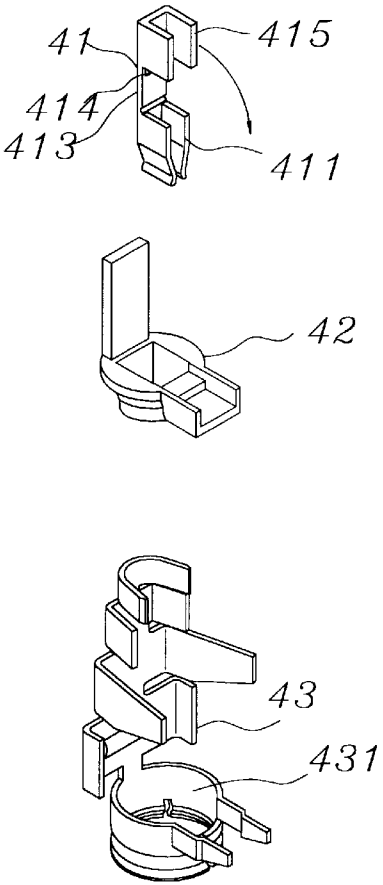
FIGS. 13A and 13B are disassembled perspective views of two different types plug parts.
Figure 13A:
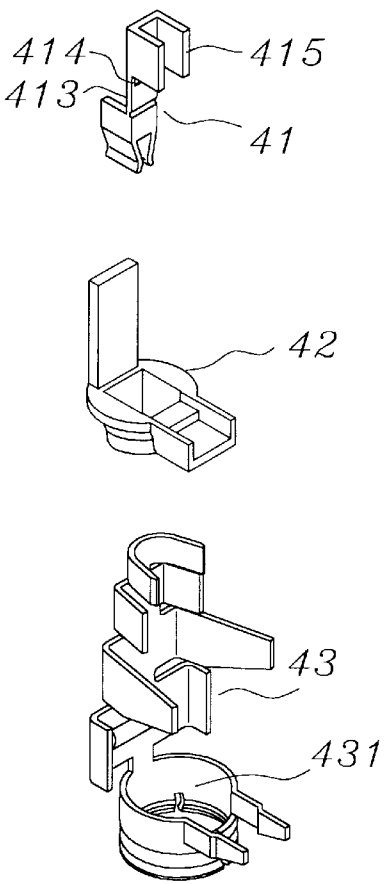

Referring to FIGS. 13A and 13B, while the receptacle part of the present invention is assembled, the female terminal 41 with the coaxial line (not shown) in company with the insulator 42 is inserted into a hole 431 in the casing 43 along the axis of the casing 43 first and then the lead wire in the coaxial line is soldered to the stop neck 414 between two stop plates 415. The FIG. 13A shows the contact plates 411 are disposed at a facial side of the upper plate 413 and the stop plates 415 are disposed at another facial side of the upper plates 413. FIG. 13B shows the contact plates 411 and the stop plates 415 are disposed at another side of the upper plate 413. The assembling job for the plug part of the present invention is much more convenient than the conventional plug part shown in FIG. 8 and it makes the inner lead wire being joined to the female terminal more steady.

Figure 15:
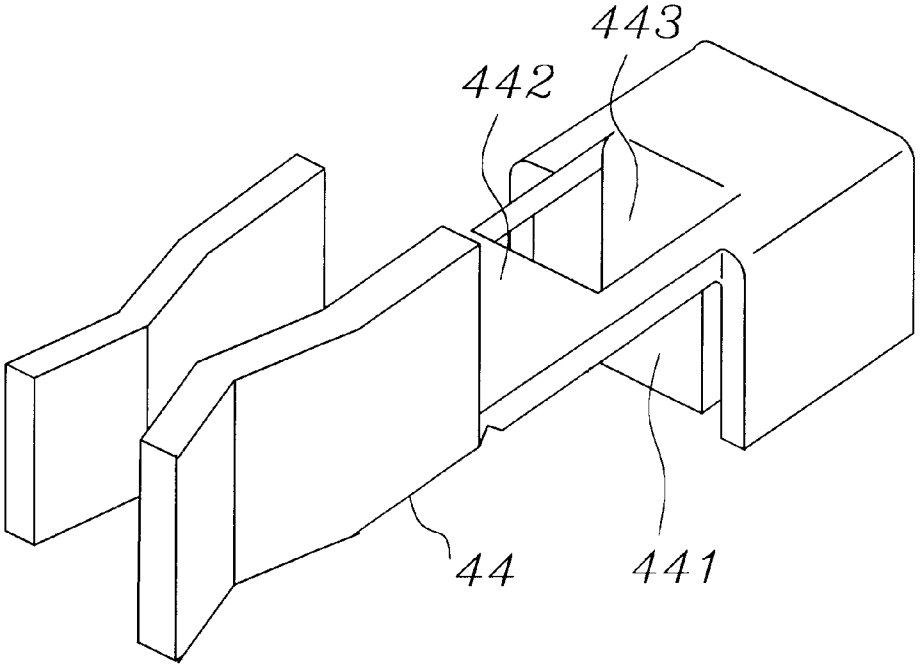
FIG. 15 is a perspective view illustrating the female terminal shown in FIG. 14 before being bent.
Figure 14:
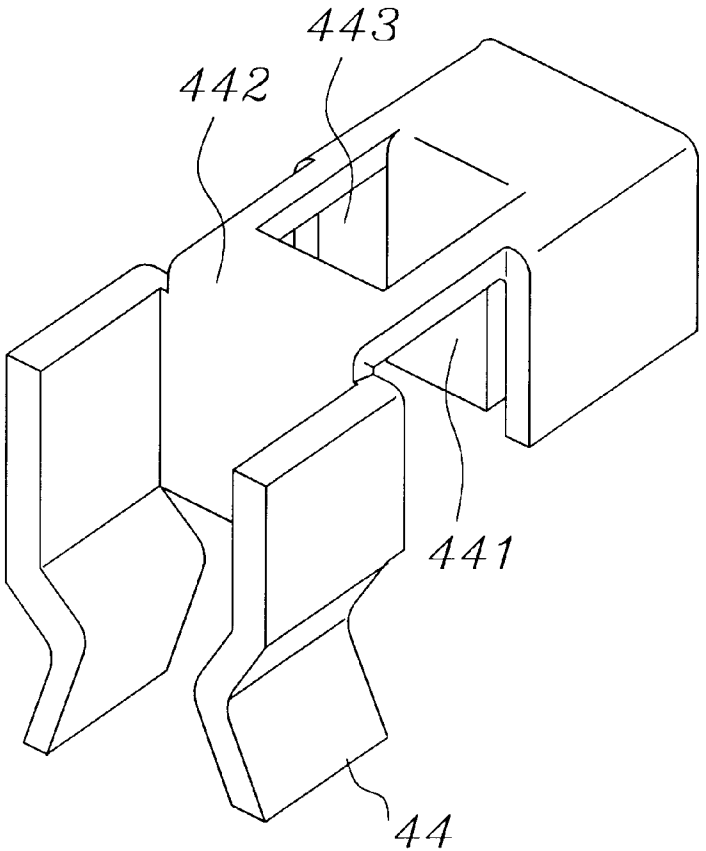
FIG. 14 is a perspective view illustrating a female terminal in a second embodiment of the present invention.

Referring to FIGS. 14 and 15, a female terminal 44 in a second embodiment is illustrated. The female terminal 44 has a stopper 441, which is an downward plate punched from the upper plate 442 so that an opening 443 is formed on the upper plate 442 instead of the stop neck 414 on the female terminal 41 shown in FIG. 12.

Figure 16:
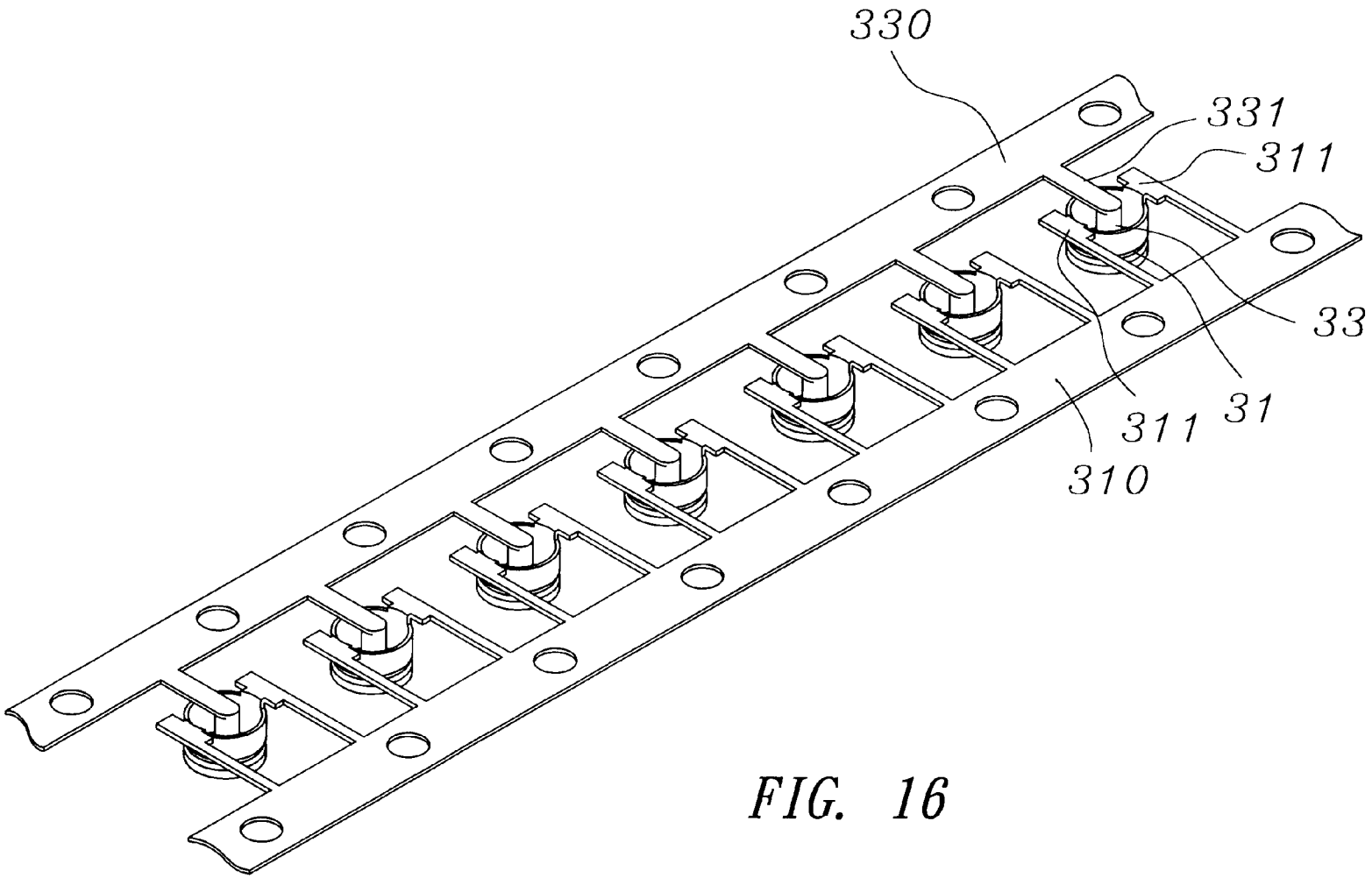
FIG. 16 is a perspective view of a blanking band of male terminals in conjunction with a blanking band of connector parts in a first embodiment of the present invention.
Figure 17:
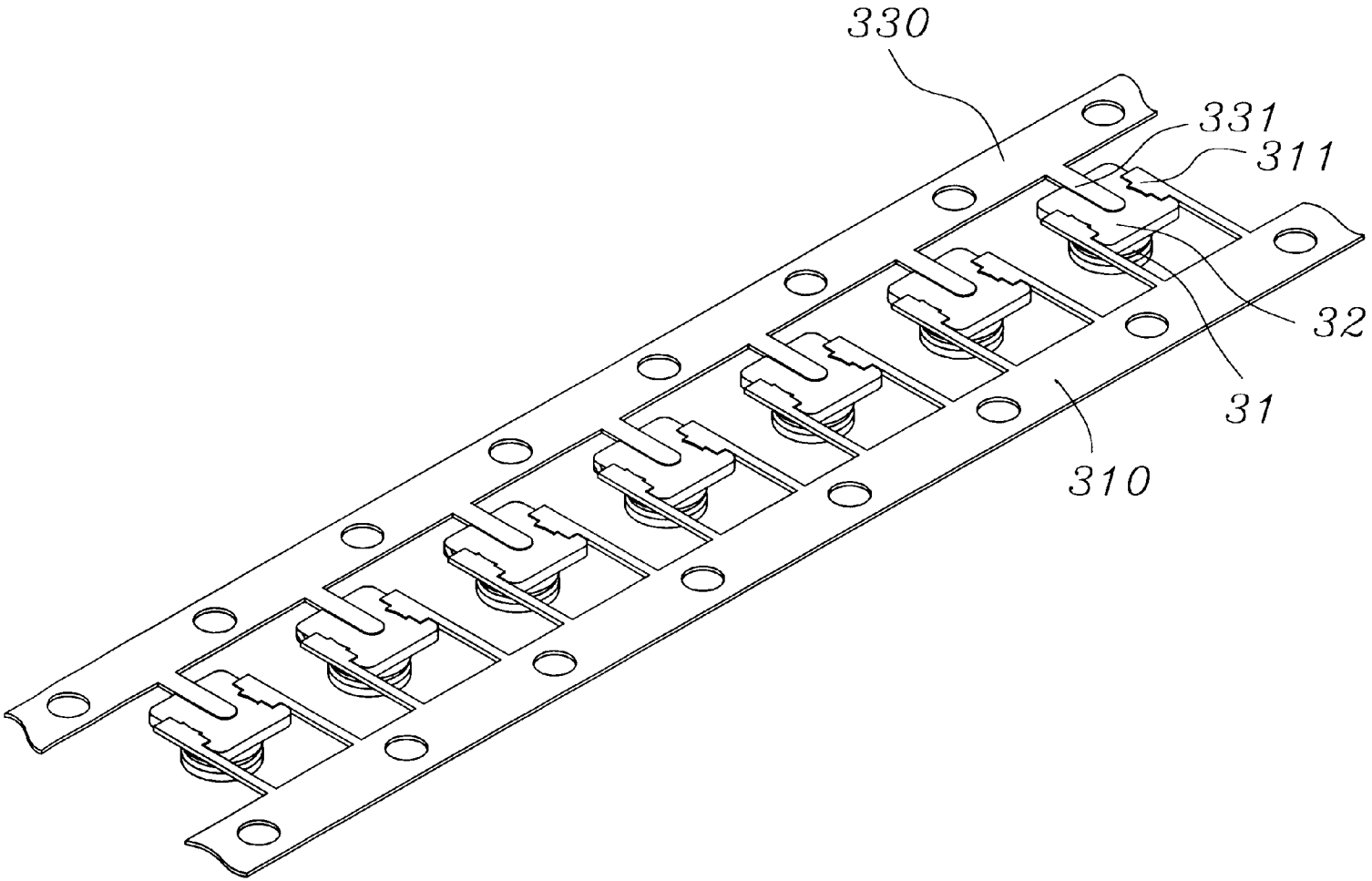
FIG. 17 is a perspective view illustrating insulators being added between the blanking band of male terminals and the blanking band of connector parts shown in FIG. 16.
Figure 18:
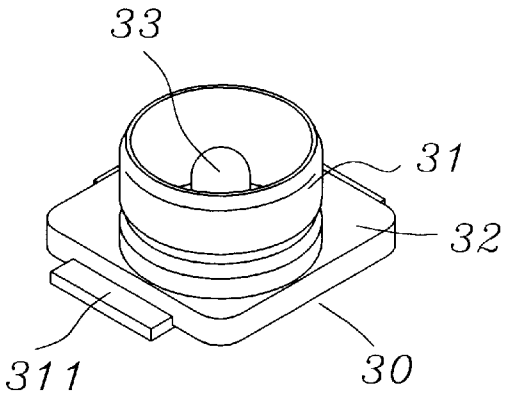
FIG. 18 is a perspective view of a receptacle part of the present invention in the first embodiment thereof.
Figure 19:
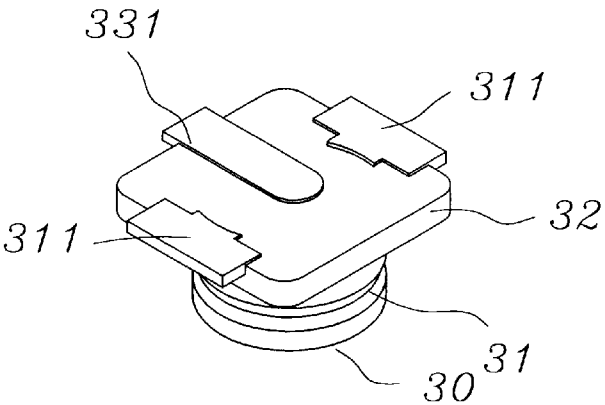
FIG. 19 is another perspective view of the a receptacle part shown in FIG. 18 illustrating the receptacle part being positioned bottom up.

Referring to FIGS. 16 and 17, the receptacle part of the present invention can be fabricated by way of a blanking band 330 of male terminals 33 and a blanking band 310 of connector bodies 31. Each of the male terminals 33 on the blanking band 330 is inserted into a central hollow area in each of the connector bodies 31 on the blanking band 310 as shown in FIG. 16. Then, the blanking band 330 and the blanking band 310 are placed in an injection mold such that a respective insulator 32 between each male terminal and each connector body 31 as shown in FIG. 17 can be formed by way of injected plastic material. Finally, the respective receptacle part as shown in FIGS. 18 and 19 can be obtained as soon as the respective lower end 331 and respective pair of guide pieces 311 are cut down. The present embodiment provides each connector body to be attached to the blanking band 310 via two opposite guide pieces 311 as shown in FIG. 17 so that a much firmer contact between each connector band 31 and the blanking band 310 can be obtained and it is not possible for the connector body 31 to become deviated during the insulators 32 being form through the injection molding so as to avoid causing defectives. While the guide pieces 311 are cut down, both lateral sides of the respective connector are subjected to an identical force respectively so that it is not possible for the respective connector part 31 to become deformed as a defective easily. Further, the connection plate 111 extending beyond the insulator 12 in the conventional receptacle 10 shown in FIG. 9 is not provided in the receptacle part 30 of the present embodiment so that short circuit resulting from other electronic components neighboring the receptacle part 30 will not occur and it is not possible to hurt fingers of the worker during fixing the receptacle part.

Figure 20:
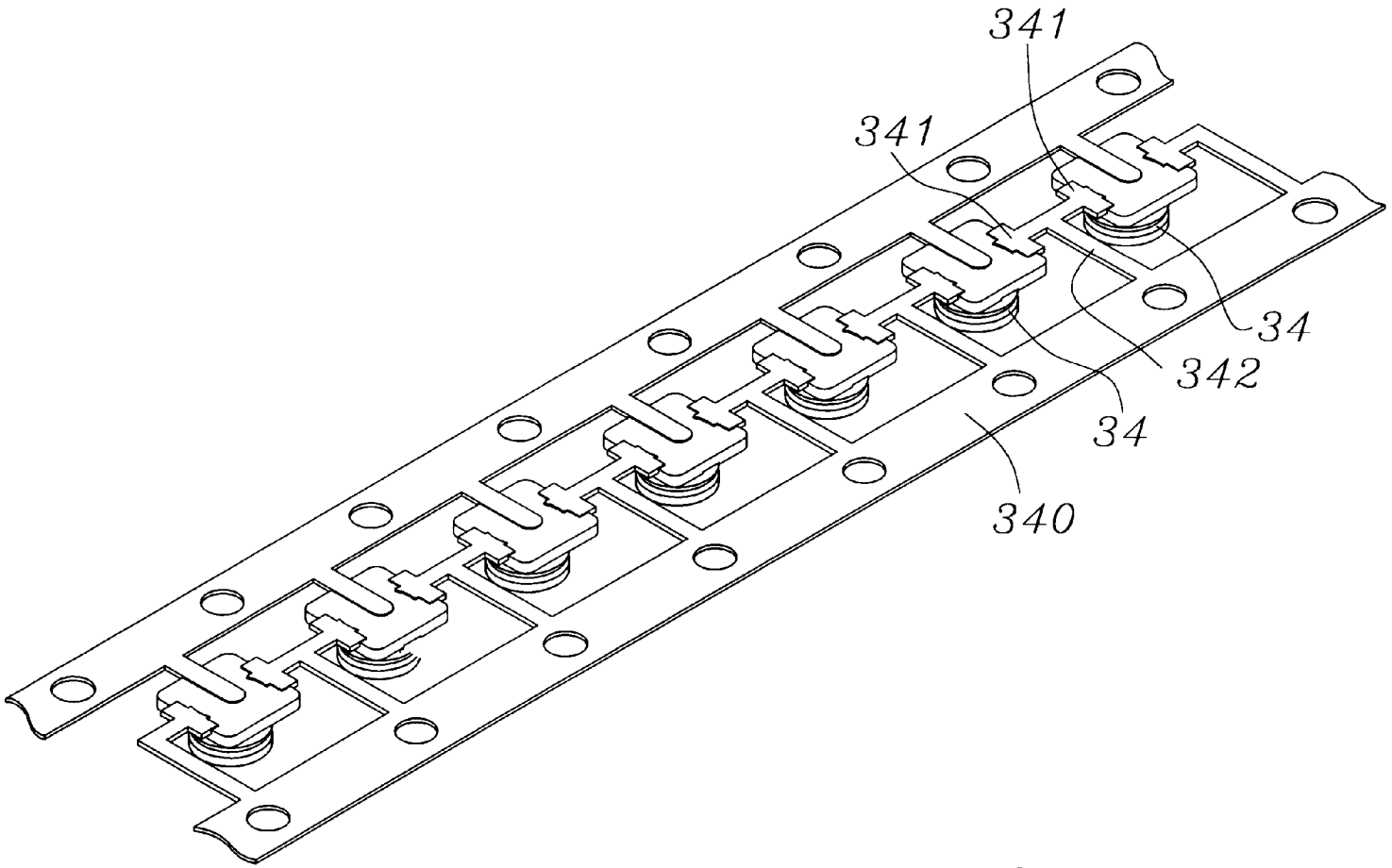
FIG. 20 is a perspective view illustrating insulators being added between the blanking band of male terminals and the blanking band of connector parts in a second embodiment of the present invention.

Referring to FIG. 20, another blanking band 340 is illustrated. The blanking band 340 provides every two neighboring guide pieces 341 connecting with two ends of top section on each T-shaped connection plate 342 respectively and the T-shaped connection plate 342 at the lower end :thereof is attached to the blanking band 340 so that :each connector part 34 can be held firmly with the connection plate 342. Hence, the receptacle part made from the blanking band 340 provides the same function as that made from the blanking band 310 shown in FIG. 17.

Figure 21:
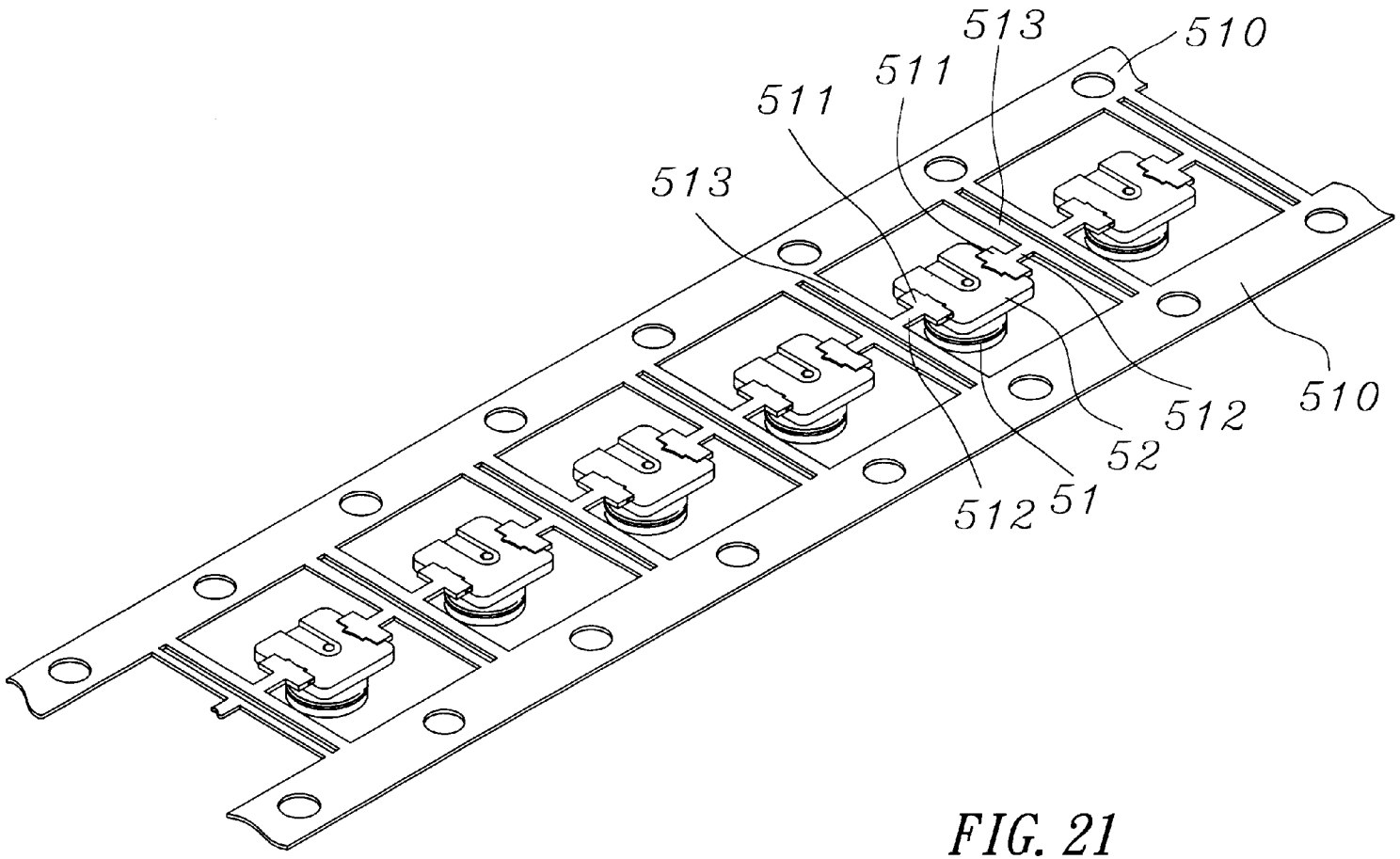
FIG. 21 is a perspective view illustrating insulators being added a blanking band of connector parts in a third embodiment of the present invention.

Referring to FIG. 21, a further blanking band 510 arrangement is illustrated. The blanking band 510 provides every two neighboring guide pieces 511 attaching with a longitudinal connection plate 512 respectively and the two connection plates 512 at another end thereof are connected to a transverse connection plate 513. Each transverse connection plate 513 at both ends thereof connects with two parallel the blanking bands 510. The insulators 52 made from the injection molding are disposed under the connector bodies respectively in advance.

Figure 22:
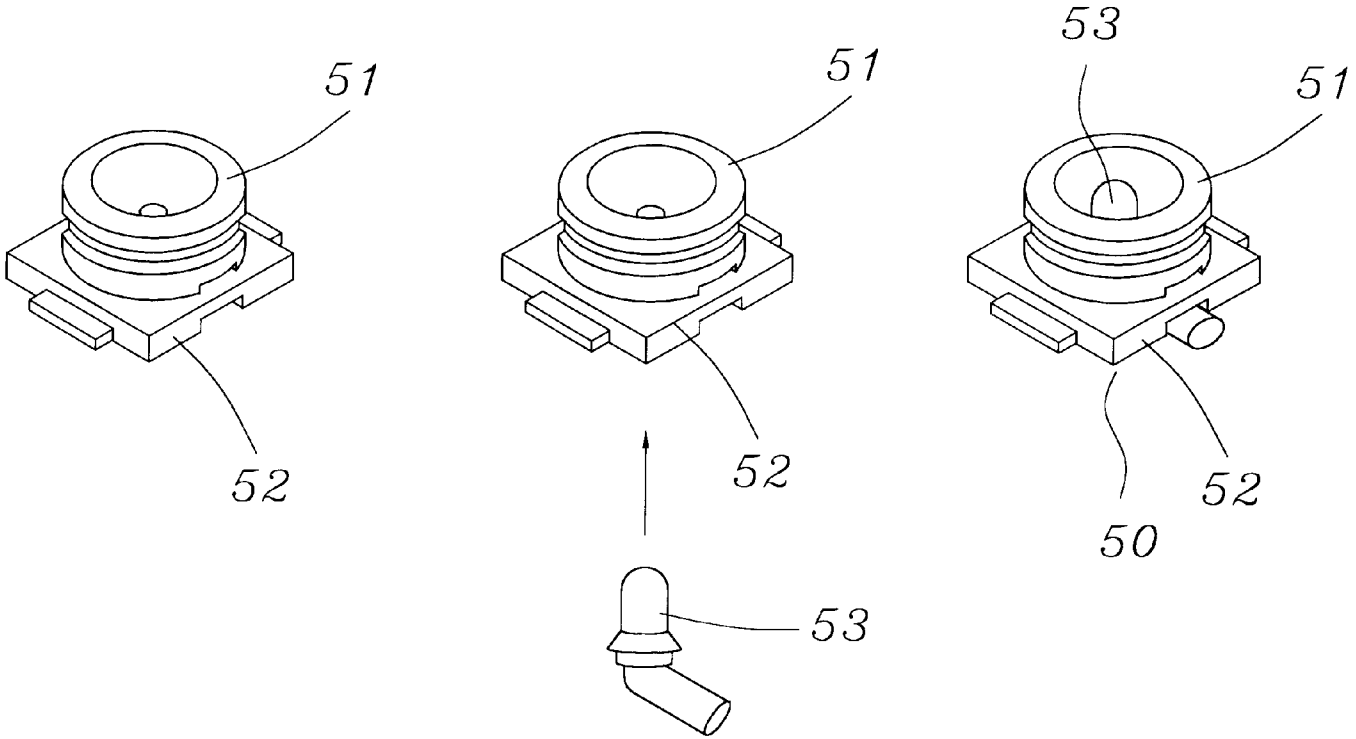
FIG. 22 is a perspective view illustrating the procedure for setting up a receptacle part in the third embodiment of the present invention.
Figure 23:
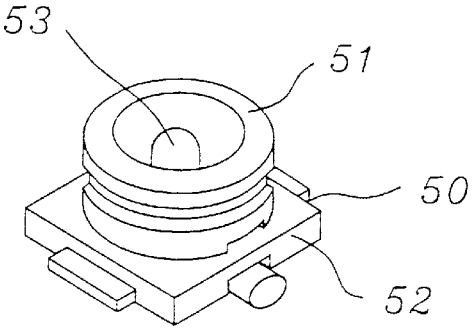
FIG. 23 is a perspective view of a receptacle part in the third embodiment of the present invention.
Figure 24:
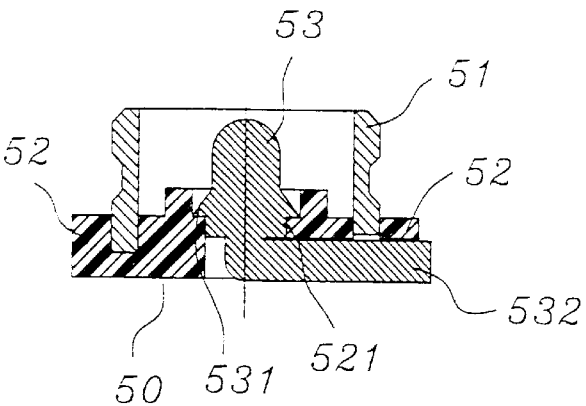
FIG. 24 is a perspective view of a receptacle part in the third embodiment of the present invention.

Referring to FIG. 22, the connector body 51 shown in FIG. 21 is utilized to join an insulator 52 and then a male terminal 53 is inserted into the connector body 51 through the a central hole in the insulator 52 so as to form a receptacle part 50 as shown in FIG. 23. The male terminal 53 of the receptacle part 50 (shown in FIG. 24) has an annular projection 531 to retain an outer rim of the central hole 521 as soon as the male terminal 53 at the upper section thereof with the annular projection 531 pierces the central hole 521. The lower section of the male terminal 53 is bent at the bottom of the insulator 52 so that the male terminal 53 can engage with the insulator 52 firmly.

Figure 25:
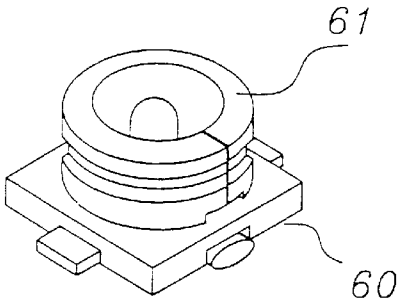
FIG. 25 is a perspective view of a receptacle part in a fourth embodiment of the present invention.

The preceding male terminal 53 is fabricated by way of a lathe so that it is possible to have a better contact surface to tightly fit with the female terminal. The connector body 51 is seamlessly made by way of extraction or a lathe. Referring to FIG. 25, a fourth embodiment of the present invention provides a receptacle part 60 and the connector part 61 is made by way of a wound plate with a seam.

Figure 26:
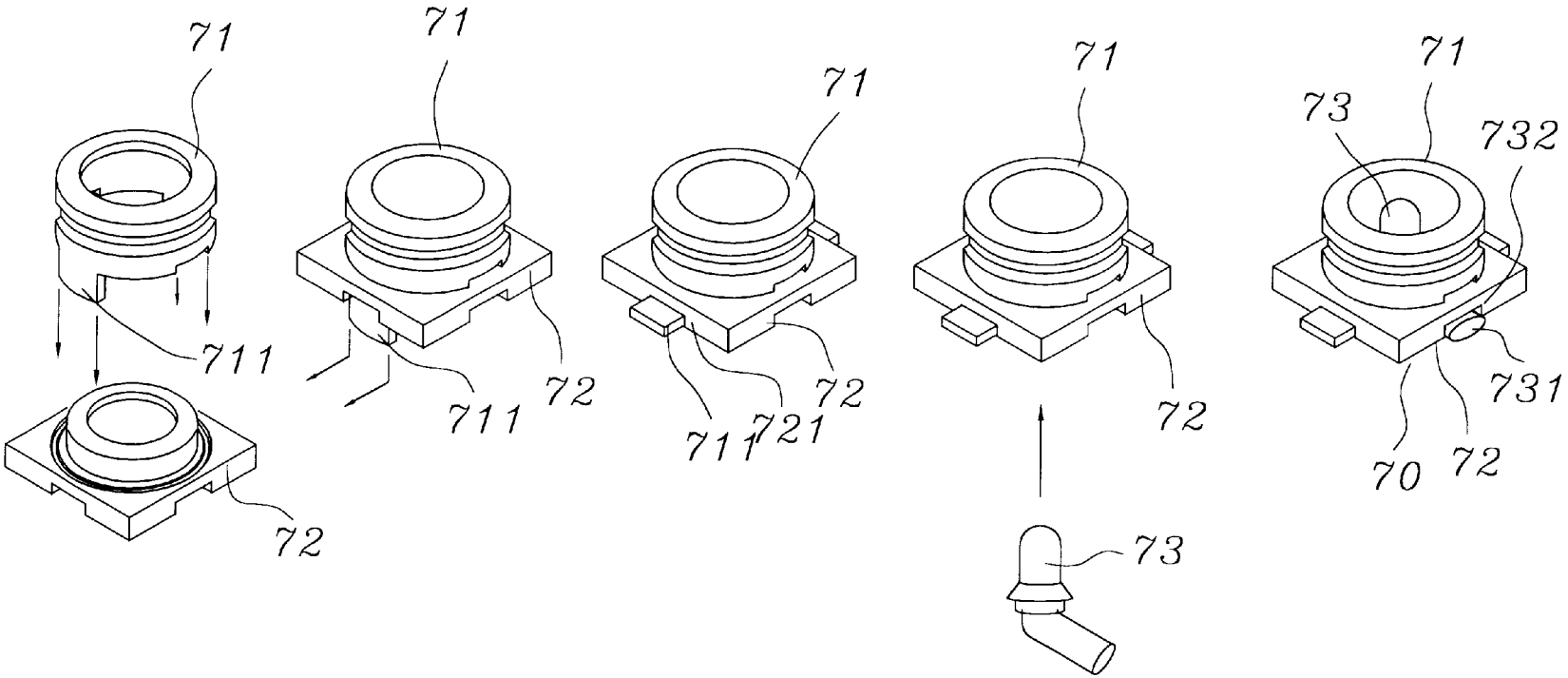
FIG. 26 is a perspective view illustrating the procedure for setting up a receptacle part in the fifth embodiment of the present invention.

Referring to FIG. 26, a receptacle part 70 is set up with the following steps. Two opposite guide extensions 711 at the lower edge of the connector body 71 pierce two opposite openings in the insulator 72 first. Then, the guide extensions 711 are bent over to fix the guide extensions 711 at the bottom of the insulator 72. Finally, the male terminal 73 is inserted into the connector body 71 and the lower end of the male terminal 73 is fixed to a further locating groove 722 at the bottom of the insulator 72.

Figure 27:
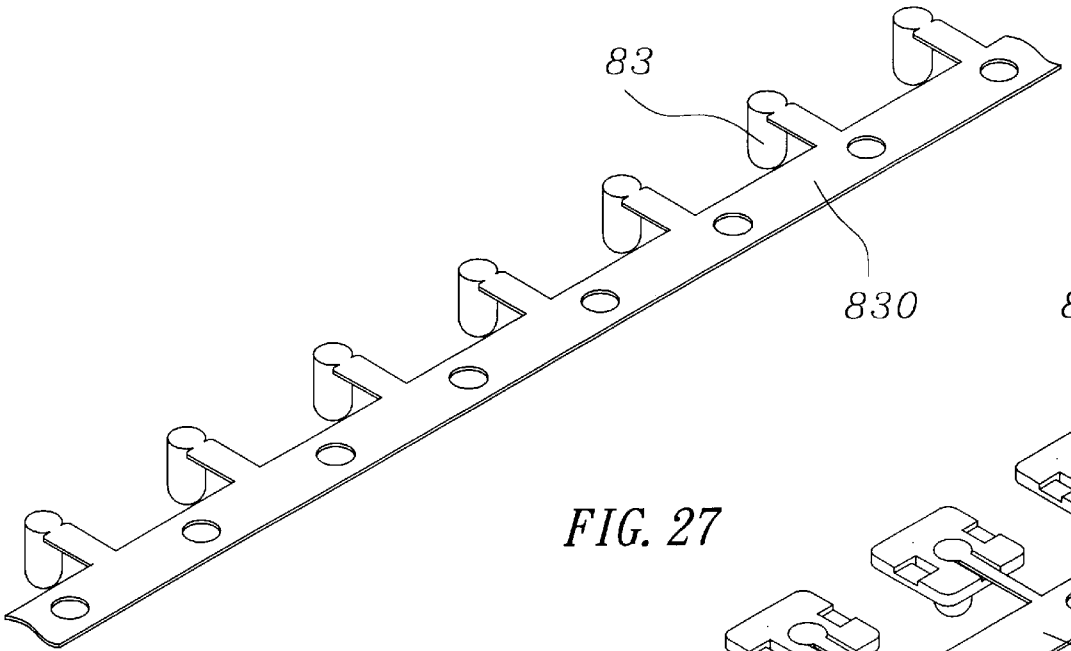
FIG. 27 is a perspective view of a blanking band of male terminals in a sixth embodiment of the present invention.
Figure 28:
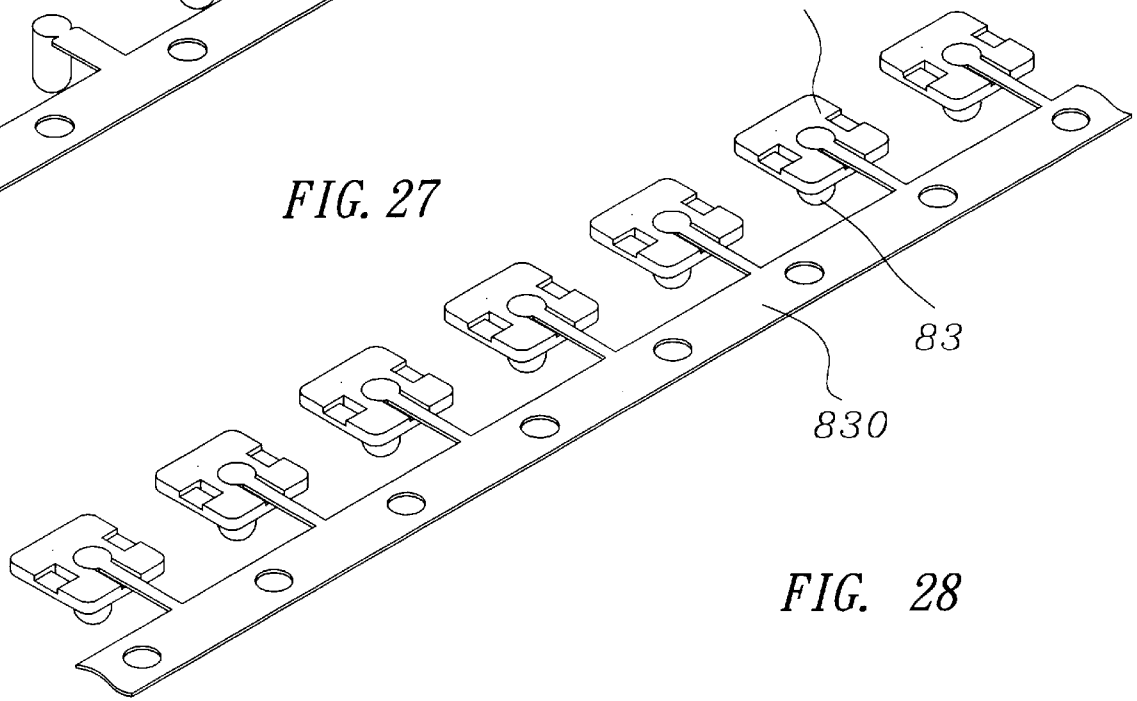
FIG. 28 is a perspective view illustrating male terminals on the blanking band shown in FIG. 27 being attached with an insulator respectively.
Figure 29:
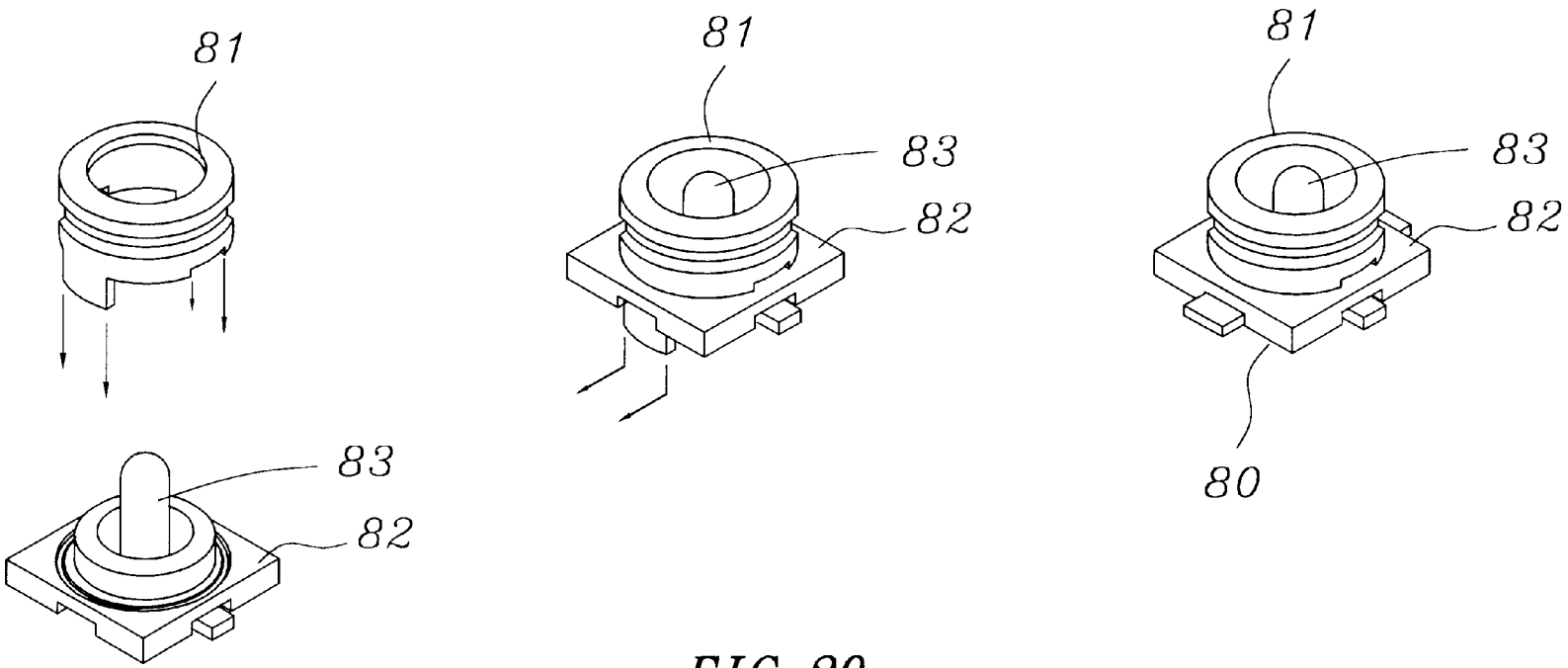
FIG. 29 is a perspective view illustrating the procedure for setting up a receptacle part in a sixth embodiment of the present invention.

Referring to FIGS. 27, 28 and 29, a male terminal blanking band 830 is provided and the male terminals 83 on the blanking band 830 are attached with insulators 82, which are made by way of injection molding, to form an arrangement the insulators 82 being joined to the male terminals 83. Then, connector bodies 81 engage with the insulators 82 by way of identical steps illustrating in FIG. 26 so that the receptacle part 80 can be set up completely as shown in FIG. 29.

Figure 31:
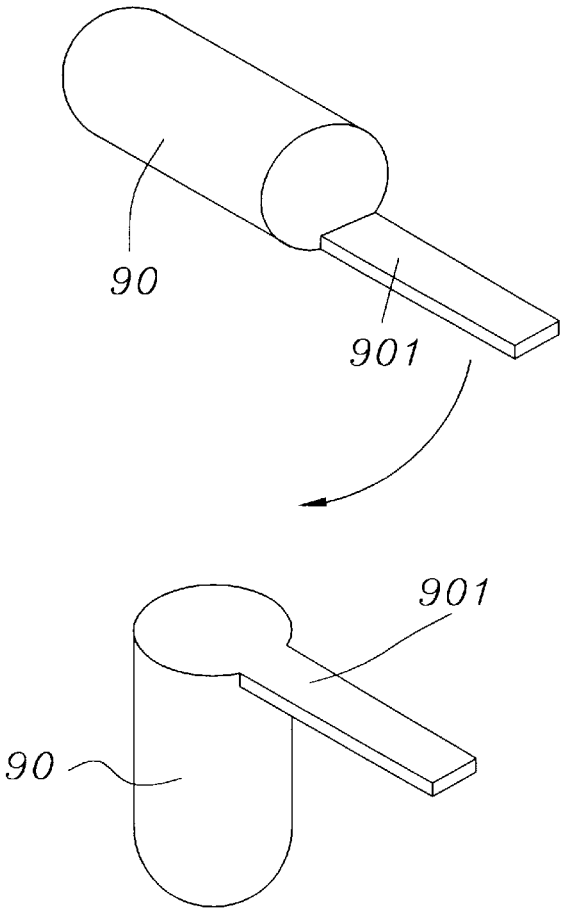
FIG. 31 is a perspective view similar to FIG. 30 illustrating another way for a male terminal at the bottom thereof being bent over.
Figure 30:
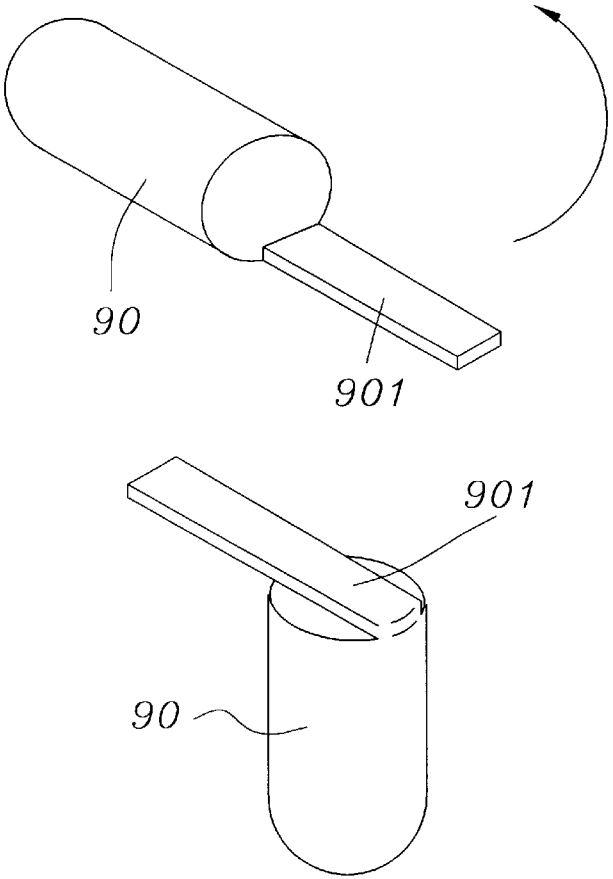
FIG. 30 is a perspective view illustrating a male terminal at the bottom thereof being bent over.

Referring to FIGS. 30 and 31, the male terminal 90 of the present invention can be formed by way of solid stamping or lathe work. An extended end 901 from the male terminal 90 can be bent over such that part of the extended end 901 can touch the bottom of the male terminal 90 as shown in FIG. 30 or can be bent over to be disposed next to the bottom of the male terminal as shown in FIG. 31 instead of contacting with the bottom of the male terminal 90.

Figure 32:
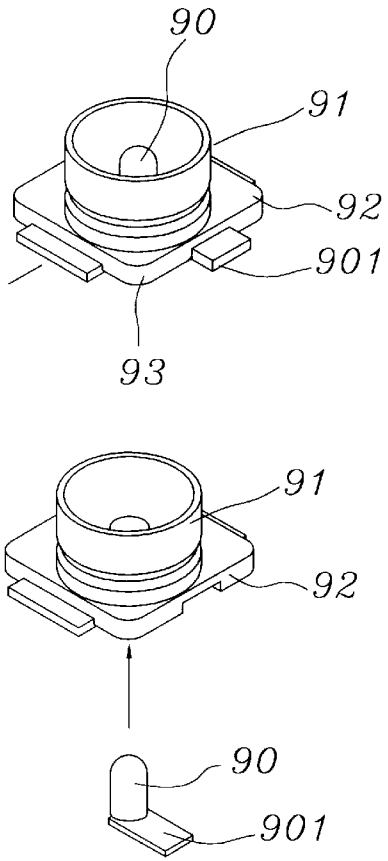
FIG. 32 is a perspective view illustrating the procedure for setting up a receptacle part in a seventh embodiment of the present. invention.

Referring to FIG. 32, a connector part 91, which is made by way of the method shown in FIG. 21, is attached with the insulator 92 to constitute a connector body. Then, the male terminal 90 is inserted into the connector body through a central hole in the insulator 92 as shown in FIG. 30 to form the receptacle part 93.

Figure 33:
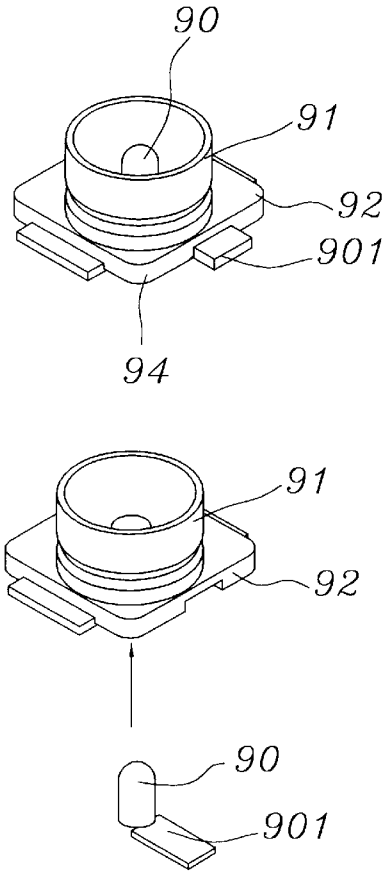
FIG. 33 is a perspective view illustrating the procedure for setting up a receptacle part in a eighth embodiment of the present invention.

Referring to FIG. 33, a connector body 91, which is made by way of the method shown in FIG. 21, is attached with the insulator 92 to constitute a connector body. Then, the male terminal 90 is inserted into the connector body through a central hole in the insulator 92 as shown in FIG. 31 to form the receptacle part 94.

It is appreciated that the connector body of the receptacle part connects with the blanking band by way of guide pieces directly so that it is not necessary to design extra connecting plates and the connector body can be made with one of preceding multiple ways so that the connector of the present invention can be made with a versatile ways in accordance with the machine available to facilitate the manufacturing process and the defective rate can be reduced substantially to save the production cost.

While the invention has been described with reference to preferred embodiments thereof, it is to be understood that modifications or variations may be easily made without departing from the spirit of this invention, which is defined by the appended claims.

What is claimed is:

1. A super mini coaxial microwave connector, comprising:

a receptacle part; and a plug part, enclosing and fitting with the receptacle part; wherein the receptacle part further comprises:

a metal connector body, providing an opening;

a first insulator, being disposed at a lower end of the metal connector body and extending into the metal connector body, providing a central projection end; and a male terminal, being inserted into the central projection end, providing a lower end extending outward from the insulator and the connector body; and the plug part further comprises:

a metal casing;

a second insulator with a central hollow part, being joined to the metal casing; and a female terminal, having an upper plate and the upper plate extending downward a bent back plate, and the back plate at both lateral sides thereof having a contact plate respectively, wherein the connector body at a bottom thereof is attached with two opposite guide pieces and the two guide pieces are bent over after piercing two corresponding slots in the first insulator so as to be retained firmly at two of a plurality of recesses disposed on a bottom of the first insulator; and a lower end of the male terminal is fixed at another one of the recesses.

2. A super mini coaxial microwave connector, comprising:

a receptacle part; and a plug part 4C, enclosing and fitting with the receptacle part; wherein the receptacle part further comprises:

a metal connector body, providing an opening;

a first insulator, being disposed at a lower end of the metal connector body and extending into the metal connector body, providing a central projection end; and a male terminal, being inserted into the central projection end, providing a lower end extending outward from the insulator and the connector body; and the plug part further comprises:

a metal casing;

a second insulator with a central hollow part, being joined to the metal casing; and a female terminal, having an upper plate and the upper plate extending downward a bent back plate, and the back plate at both lateral sides thereof having a contact plate respectively, the upper plate on the female terminal insulator having a concave stop neck, the concave stop neck having two opposite bent stop plates extending downward from opposing sides of a rear of the concave stopper respectively.

3. The super mini coaxial microwave connector according to claim 2, wherein the connector body is seamlessly formed by way of extraction.

4. The super mini coaxial microwave connector according to claim 2, wherein the first insulator is formed by way of a blanking band with a plurality of male terminal blanks being placed in a mold with plastic material being injected into the mold.

5. The super mini coaxial microwave connecter according to claim 2, wherein the male terminal is solid with a lower extended part and the extended part is bent to be disposed under a bottom of the male terminal.

6. The super mini coaxial microwave connecter according to claim 2, wherein the male terminal is solid with a lower extended part and the extended part is bent to be disposed next to periphery of a bottom of the male terminal.

7. The super mini coaxial microwave connecter according to claim 2, wherein the male terminal at an upper end thereof is round.

8. The super mini coaxial microwave connecter according to claim 2, wherein the connector body is fabricated by way of lathe work.

9. The super mini coaxial microwave connecter according to claim 2, wherein the male terminal is fabricated by way of stamping.

10. The super mini coaxial microwave connecter according to claim 2, wherein the male terminal is fabricated by way of lathe work.

11. The super mini coaxial microwave connecter according to claim 2, wherein said two contact plates and said two stop plates are disposed at a side of the back plate.

12. The super mini coaxial microwave connecter according to claim 2, wherein said two contact plates are disposed at a side of the back plate and said two stop plates are disposed at another side of the back plate.

13. The super mini coaxial microwave connector according to claim 2, wherein a recess is disposed between the respective back plate and the upper plate.

14. The super mini coaxial microwave connector according to claim 3, wherein the stopper is a bend downward plate made by way of a hole being punched at the upper plate.

15. The super mini coaxial microwave connector according to claim 2, wherein the first insulator is formed by way of a blanking band with a plurality of connector body blanks being placed in a mold with plastic material being injected into the mold.

16. The super mini coaxial microwave connector according to claim 15, wherein the male terminal provides an annular projection engaging with an outer edge of the first insulator.

17. the super mini coaxial microwave connector according to claim 2, wherein the first insulator is made by way of following steps:

(1) a first blanking band with a plurality of male terminal blanks being disposed on a second blanking band with a plurality of connector body blanks with each of the terminal blanks being in a central hollow part of each of the connector body blanks; and (2) placing the preceding first blanking band and the second blanking band in a injection mold and the first insulator being form via plastic material being injected into the mold.

18. The super mini coaxial microwave connector according to claim 17, wherein each of the connector body blanks is connected to the second blanking band with two guide pieces directly.

19. The super mini coaxial microwave connector according to claim 17, wherein each of the guide pieces connects one oftwo upper ends of a T-shaped connector and a lower end of the T-shaped connector connects with the second blanking band.

20. The super mini coaxial microwave connector according to claim 17, wherein each of the guide pieces connects with an end of a longitudinal connecting piece respectively and another end of the longitudinal connecting piece connects with a transverse connecting plate respectively; and both ends of the transverse connecting plate connect with two opposite and parallel blanking parts respectively on the second blanking band.

* * * * *